US005781842A

United States Patent [19]

Ito et al.

[11] Patent Number: 5,781,842

[45] Date of Patent: Jul. 14, 1998

[54] IMAGE FORMING APPARATUS CAPABLE OF AUTOMATICALLY INTERLEAVING NORMAL IMAGE COPIES BETWEEN CORRESPONDING TRANSPARENCY IMAGE COPIES

[75] Inventors: Hiroyasu Ito, Okazaki; Tomokazu Kato; Eiichi Yoshida, both of Toyokawa, all of Japan

[73] Assignee: Minolta Co., Ltd., Osaka, Japan

[21] Appl. No.: 653,525

[22] Filed: May 24, 1996

[30] Foreign Application Priority Data

May 25, 1995 [JP] Japan ..... 7-152197

[51] Int. Cl.[6] ..... G03G 15/00

[52] U.S. Cl. ..... 399/382

[58] Field of Search ..... 399/382

[56] References Cited

U.S. PATENT DOCUMENTS 4,681,428 7/1987 Devoy ..... 399/382

5,481,353 1/1996 Hicks et al. ..... 399/382

5,610,700 3/1997 Yoshizuka ..... 399/382 X

FOREIGN PATENT DOCUMENTS 62-59971 3/1987 Japan .

4-362968 12/1992 Japan .

*Primary Examiner*—William J. Royer

[57] ABSTRACT

A color image forming apparatus which controls a copy operation sequence, when an intervening sheet mode is set, to alternately discharge intervening sheets copied with an original document image and OHP sheets copied with the identical original image so as to pile on each other. Under the copy operation sequence in the intervening sheet mode, the color image forming apparatus is controlled to form a full-color copy image on the OHP sheets and to form a monochrome copy image on the intervening sheets.

7 Claims, 7 Drawing Sheets output paper on non-sort bin output paper on sort bin
(first and the following bin )

IMAGE FORMING APPARATUS CAPABLE OF AUTOMATICALLY INTERLEAVING NORMAL IMAGE COPIES BETWEEN CORRESPONDING TRANSPARENCY IMAGE COPIES

BACKGROUND OF THE INVENTION

1. Field of the Invention

The present invention relates to image forming apparatus operable in a mode (OHP intervening sheet mode) for discharging OHP (overhead projector) sheets copied with an original document image thereon and OHP intervening sheets alternately and laying them one on top of another.

2. Description of the Related Art

Japanese Laid-Open Paten Application No.62-59971 discloses a copier having such a function that an OHP sheet copied original image is discharged on a blank OHP intervening sheet (general sheet) when OHP intervening sheet mode is set.

Japanese Laid-Open Patent Application No.4-362968 discloses a copier having the function that an OHP sheet copied with an original image is discharged on an OHP intervening sheet (general sheet) which has the identical document image thereon, when OHP intervening sheet mode is set.

OHP intervening sheet is devised for the purpose of making a copied image on each OHP sheet easy to be seen or confirmed by interposing a general sheet between OHP sheets, for if only transparent OHP sheets are laid one on top of another, a copied image of each OHP sheet is difficult to be seen. Accordingly, the image formed on each OHP intervening sheet is sufficient only if the image formed on an OHP sheet is confirmable. Namely, the image formed on each OHP intervening sheet is needless to be identical with the image formed on an OHP sheet.

In the conventional OHP mode, when color copying is executed on an OHP sheet, the intervening OHP sheet is also formed with a colored image. Color copying requires a total of four times electrostatic latent image forming processes for each color toner of magenta, cyan, yellow and black, as well as a total of four times transfer processes. Thus, it takes a long time until copying is completed. Moreover, copying cost becomes expensive.

Color copying is not necessarily required to form images on OHP intervening sheets. However, according to conventional apparatuses, if monochrome copying is intended for OHP intervening sheets, copying for OHP sheets inevitably should also become monochrome. Accordingly, the demand of performing color copying on OHP sheets cannot be accomplished.

SUMMARY OF THE INVENTION

A main object of the present invention is to reduce the time required for copying.

Another object of the present invention is to reduce the cost of copying.

Further, an object of the present invention is to efficiently execute copying for OHP sheets and for OHP intervening sheets.

These and other objects of the present invention are accomplished by providing a color copier comprising means for forming an image, means for setting an intervening sheet mode, means for controlling a copy operation sequence, when the intervening sheet mode is set, to alternately discharge intervening sheets copied with each original document image and OHP sheets copied with the identical original image so as to pile on each other, and means for controlling the image forming means, under said copy operation sequence in the intervening sheet mode, to form a full-color copy image on the OHP sheets and to form a monochrome copy image on the intervening sheets.

These and other objects, advantages and features of the invention will become apparent from the following description thereof taken in conjunction with the accompanying drawings with illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
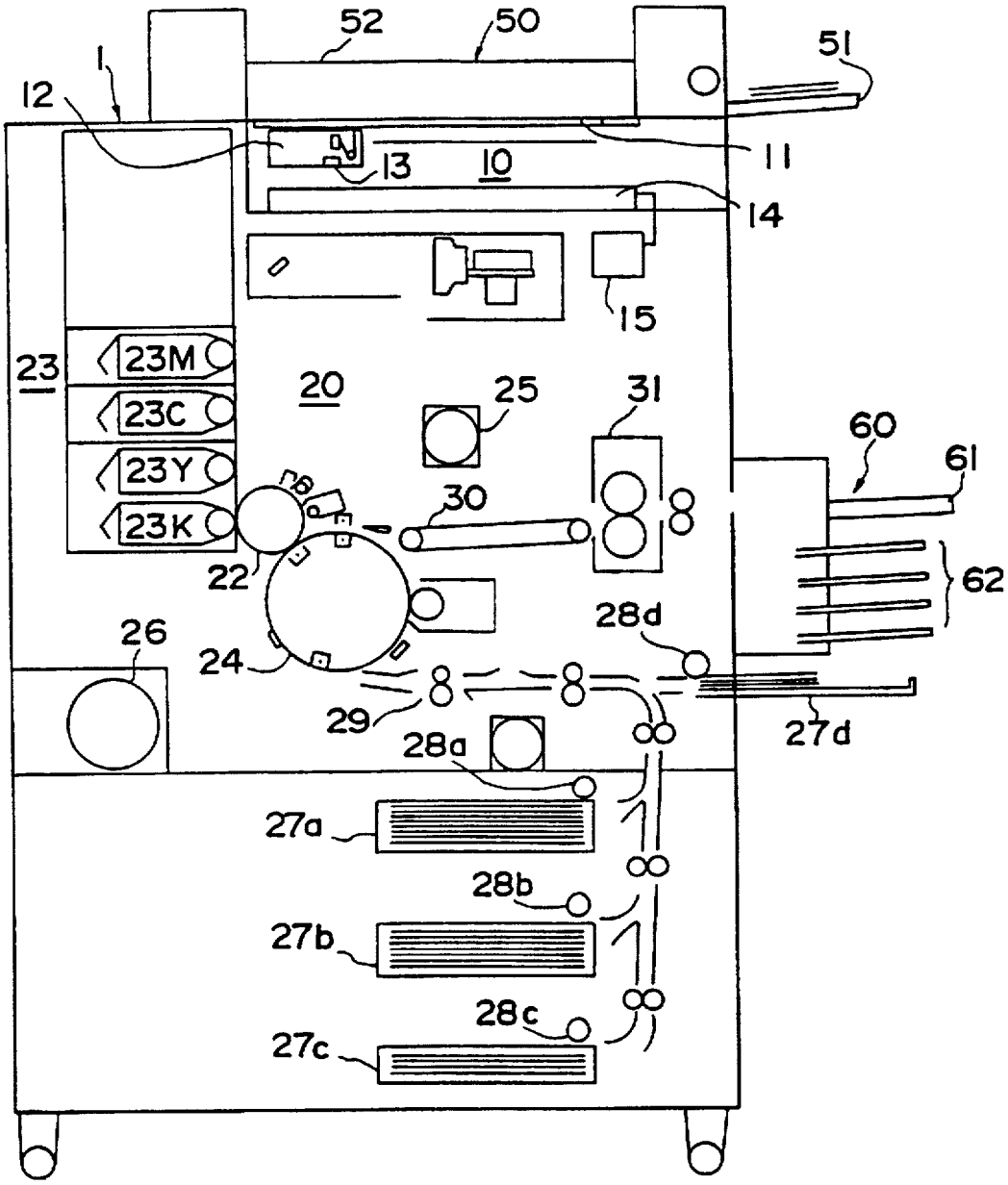
FIG. 1 is a typical diagram showing the entire mechanism of a copying apparatus of an embodiment.

Referring now to the drawings, the color copier of the present invention will be explained.

Entire construction of a copying apparatus: FIG. 1

The copying apparatus adopted by the present embodiment is a digital color copier. On document platen 11 of copier body 1, automatic document feeder (ADF) 50 is provided. Further, sorter 60 is attached at a sheet discharge portion of copier body 1.

ADF 50 picks up an original document set on original tray 51 with the original image surface thereof in face-down condition from the uppermost one to feed to a predetermined position on document platen 11, stops the fed document at the predetermined position until the scanning of said document is completed, then transports said document in the same direction as the feeding direction thereof to discharge it onto tray 52 and feed the next document on document tray 51 (the uppermost document) to the predetermined position to proceed it thereafter in the same way. The well-known constructions and controls are applicable as those of ADF 50. Namely, the construction and control of ADF 50 are not limited to those of the apparatus shown in FIG. 1, and for example, an apparatus of document circulating type, document reversing type or the like is applicable.

Copier body 1 includes image reading position 10 and printing portion 20.

Image reading portion 10 reads the document stopped at the predetermined portion of document platen 11 by exposure scanning of scanner 12 to convert into electrical signals line by line, and generates image data corresponding to the document image based on the obtained electrical signals. That is, image reflection light is converted to electrical signals by color image sensor 13 provided on scanner 12 to execute a predetermined process to this obtained electrical signals in image processing portion 14. The image data obtained by this process is sent to print head control portion 15.

Print head control portion 15 converts said image data to laser diode driving data to modulate the driving current of laser diode 211 (Refer to FIG. 3) by this driving data. The laser beam outputted from laser diode 211 which is driven by the modulated driving current is guided by a well-known optical system comprising a polygonal mirror and the like, and scans the charged surface of photosensitive drum 22 in an axial direction, thereby an electrostatic latent image corresponding to the document image is formed on the charged surface of photosensitive drum 22. This electrostatic latent image formation process is executed, for example, in case of full-color copying, for each developing color of magenta, cyan, yellow and black in a predetermined order. In case of monochrome copying, an electrostatic latent image corresponding to luminescence of document image is formed.

Figure 3:
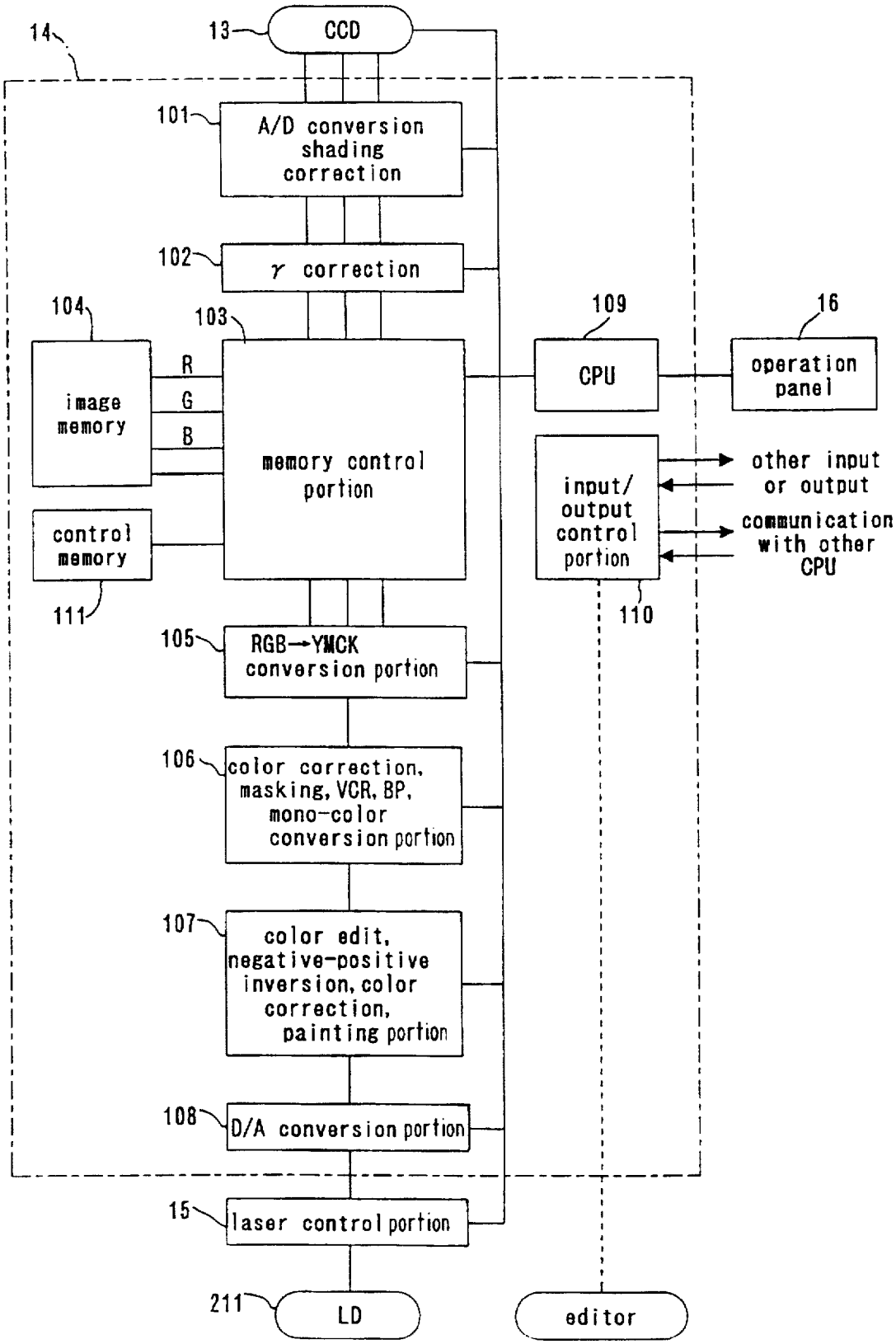
FIG. 3 is a block diagram showing a control circuit of the copying apparatus of the embodiment.

In printing portion 20, images are formed by an electrophotographic process. Namely, an electrostatic latent image formed on the surface of photosensitive drum 22 is developed to form a visible image by a developer supplied by a developing unit 23 (any one of 23M, 23C, 23Y and 23K) accommodating toner of a color corresponding to said electrostatic latent image, and this toner image is transferred to a sheet wound around the surface of transfer drum 24. In case of full-color copying, each toner image of magenta, cyan, yellow and black is transferred onto the identical sheet repeatedly. The sheet with transferred toner images thereon is peeled off the transfer drum, transferred to fixing device 31 via transfer belt 30, and then an image fixing process adopting heat pressure by said fixing device 31 is performed. The sheet which has completed the image fixing process is discharged from the copier body 1 and sent to sorter 60. The discharge of the sheet is detected by an unillustrated sensor to send it to CPU 109 (FIG. 3). Numeral 25 is a motor for rotationally driving photosensitive drum 22, transfer drum 24 and the rollers rendering to transport sheets. Numeral 26 is a motor for positioning the selected developer at a predetermined developing position (height) by vertically moving developing unit 23. Selection of a developer is performed based on a later described color/monochrome switching process, a mode set by a key input process via operation panel 16, each timing in copy sequence and the like. Though the present embodiment adopts an elevator type developing unit 23, a developing unit of another type such as rotary type is applicable.

As to the sheet wound around the surface of transfer drum 24 as described above, a sheet is picked up by feeding roller 28*a*, 28*b*, 28*c* or 28*d* corresponding to any one of feeding cassettes 27*a*, 27*b*, or 27*c* or manual feeding tray 27*d*, transported to timing roller pair 29 through the sheet transporting path, thereafter sent out at a predetermined timing by said timing roller pain 29 to be wound around by electrostatic force and the like. The selection of feeding cassette 27*a*, 27*b* or 27*c* or manual feeding tray 27*d* is performed by key input of operation panel 16 or setting paper sheets on manual feeding tray 27*d*, as described later. A plurality of paper sheets are capable of being set on manual feeding tray 27*d*.

The size of paper sheets accommodated in feeding cassette 27*a*, 27*b* or 27*c* is detected by an unillustrated sensor and sent to CPU 109. The size of paper sheets fed from manual feeding tray 27*d* is also detected by an unillustrated sensor and sent to CPU 109.

Sorter 60 discharges sheets discharged from copier body 1 onto a predetermined bin in accordance with a sorting mode set at that time. The sorting mode includes a sort mode, a grouping mode and non-sort mode. The sort mode is for discharging each sheet copied with the identical original document image onto separate bins in turn starting with the first bin (the uppermost bin among bin group 62). That is, in the sort mode, one set of copies is obtained in one bin.

The grouping mode is for discharging sheets copied with the identical document image onto the identical bin. And the non-sort mode is for discharging all copied sheets to non-sort bin 61. Non-sort bin 61 may be assumed as the first bin and the uppermost bin among bin group 62 may be assumed as the second bin to assume the bins following below as the bins of the number following the above two bins. The mechanism of the sorter and the control for sorting are well-known.

Control Circuit and Image Data Process: FIG. 3

Each image signal R, G, and B which is obtained by converting the image signal produced by color image sensor (CCD) 13 into electric signal is processed by image processing portion 14 to obtain image data which is to be sent to laser control portion 15. Image processing portion 14 includes analog-to-digital (A/D) conversion and shading correction portion 101, γ correction portion 102, memory control portion 103, image memory 104, RGB/YMCK conversion portion 105, color correction (masking, UCR, BP, mono-color conversion) portion 106, color edit negative-positive reversal, color conversion, painting) portion 107, digital-to-analog (D/A) conversion portion and control memory 111. These are connected with CPU 109 for controlling copier body 1. CPU 109 controls copying operation by inputting or outputting with respect to external devices and the like via input and output control portion 110.

Each image signal inputted from CCD 13 to image processing portion 14 is performed A/D conversion and shading correction in A/D conversion and shading correction portion 101, and performed chromatic correction in γ correction portion 102, thereafter stored in memory 104 by memory control portion 103. Next the image data is read out of memory 104 every developing process synchronized with said each developing process of yellow, magenta, cyan and black, and converted to data for toner of corresponding color by RGB/YMCK conversion portion 105. Further, the data is performed color correction and color edit if necessary, and thereafter converted to analogous video signal in D/A conversion portion 108 to be outputted to laser control portion 15.

In control memory 111, stored are various modes inputted by operation panel 16 and various conditions detected by sensors. CPU 109 for control reads out these data at a predetermined timing during a copying sequence, and performs sequence controls of CCD 13, image processing portion 14 and laser (print head) control portion 15, sequence control of copy operation and each process described below.

Figure 2:
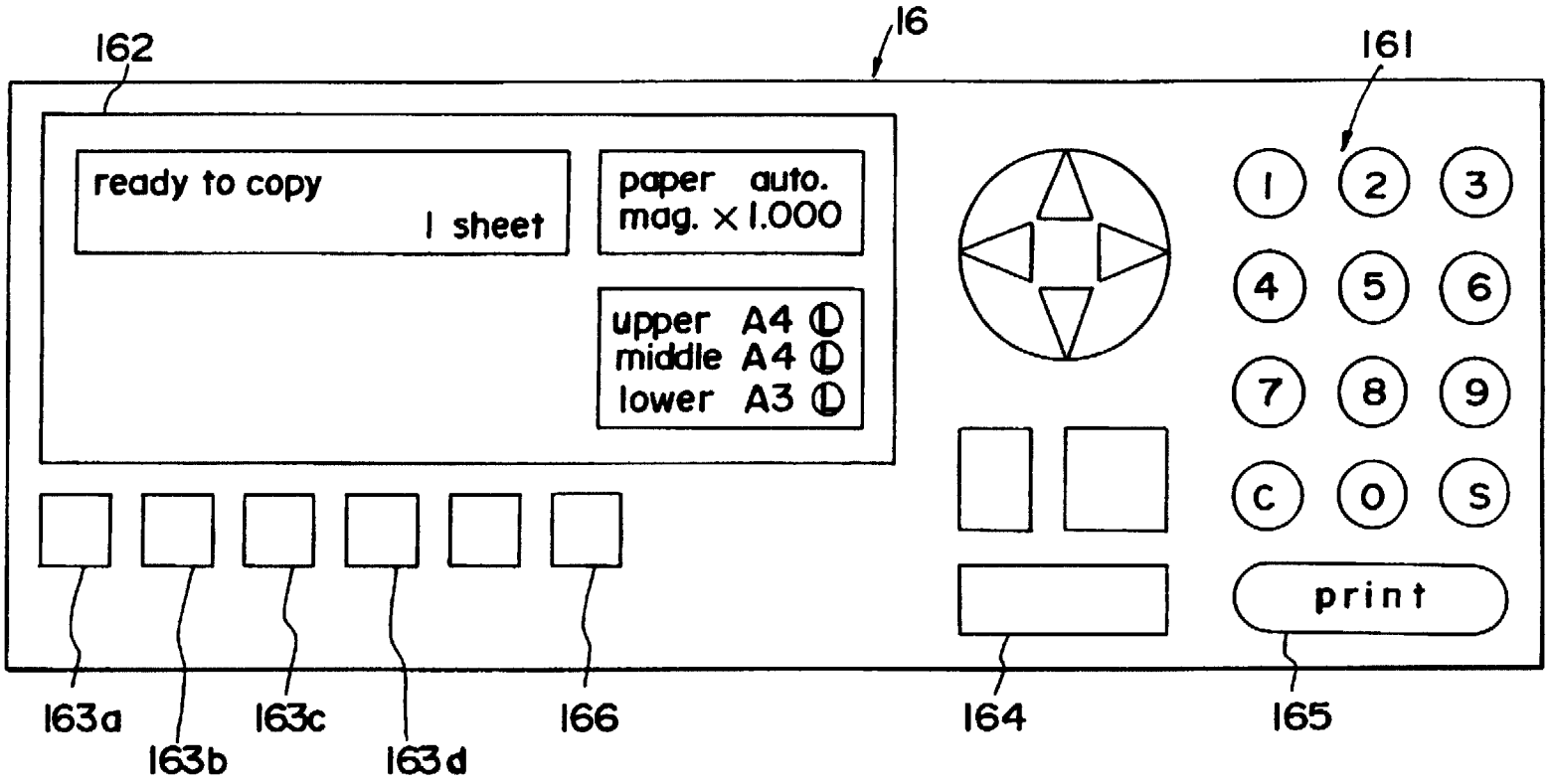
FIG. 2 is an illustration showing an operation panel of the copying apparatus of the embodiment.

Operation panel and mode setting: FIGS. 2 and 3.

On this side of document platen 11, operation panel 16 shown in FIG. 2 is provided.

On operation panel 16, provided are OHP intervening sheet mode key 163*a* for setting or cancelling OHP intervening sheet mode, color mode key 163*b* for selecting any color mode (full color, monochrome, a single color of yellow, a single color of magenta, a single color of cyan, three kinds of double color or triple color), sort mode key 163c for selecting any sort mode (sorting, grouping or non-sorting), paper selection key 163d for selecting any paper size by selecting any feeding cassette (upper cassette 27a, middle cassette 27b or lower cassette 27c), print key 165 for indicating start of print operation, ten key 161 for inputting numeral values (0 and 1 to 9), enter key 164 for fixing inputted state, mode reset key 166 for resetting set mode or set copy number to a standard state, display portion 162 for displaying set modes or state of copier, and the like.

When OHP intervening sheet mode key 163a is pressed, that data is sent to CPU 109. CPU 109 sets the OHP intervening sheet mode and displays that effect on display portion 162 if the copying state until then is not in OHP intervening sheet mode. While if the copying state until then is in OHP intervening sheet mode, CPU 109 resets OHP intervening sheet mode.

When color mode key 163b is pressed, that information is sent to CPU 109, and CPU 109 selects any of the above-mentioned color modes in rotation in accordance with the copying state until then. Further, the selected color mode is displayed on display portion 162. A color mode of high frequency of use may be selected prior to other color modes.

When sorting mode key 163c is pressed, that information is sent to CPU 109, and CPU 109 selects any of the above-mentioned sorting modes in rotation in accordance with the copying state until then. Further, the selected sorting mode is displayed on display portion 162.

When paper selection key 163d is pressed, that information is sent to CPU 109, and CPU 109 sets any of the feeding ports of the above-mentioned feeding cassettes in rotation as the selected feeding port in accordance with the copying state until then. When sheets are set at manual feeding port 27d, manual feeding port 27d is set as the selected feeding port. An unillustrated sensor provided in the vicinity of manual feeding port 27d detects that sheets are set at manual feeding port 27d, and that detection signal is sent to CPU 109. When OHP intervening sheet mode is set and at the same time sheets are set at manual feeding port 27d, CPU 109 interprets that OHP sheets are set at manual feeding port 27d.

Two or less digit values inputted by ten key 161 is processed as the number of copies (the number of multi-copies) to an identical original document. Further, CPU 109 displays the number of unfinished copies at each point on display portion 162.

When print key 165 is pressed, CPU 109 starts the process for performing a copy operation in accordance with a predetermined sequence.

Control by CPU 109

Figure 4:
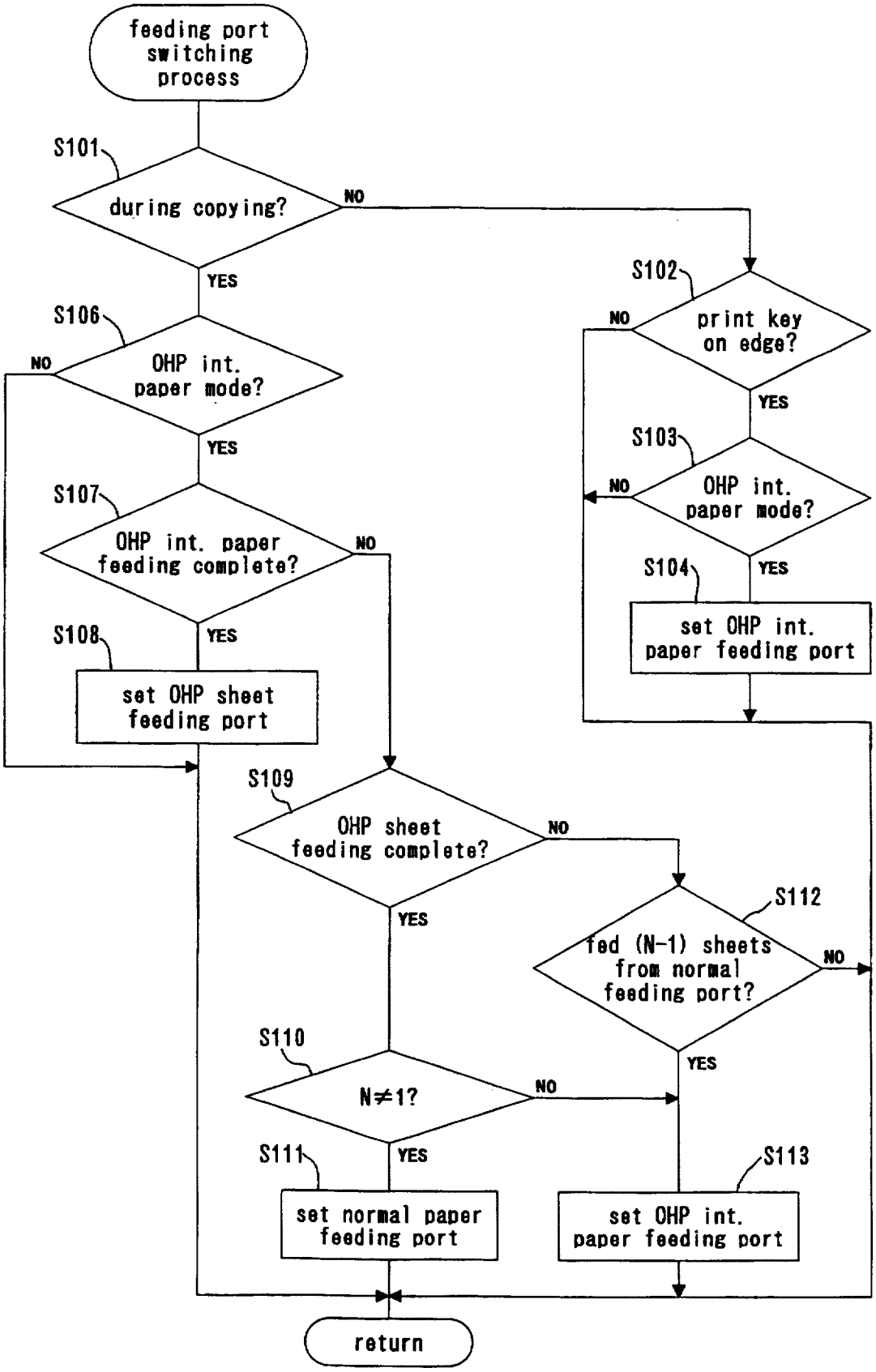
FIG. 4 is a flow chart showing a feeding port switching process executed by a CPU which controls the operation of the copying apparatus of the embodiment.
Figure 5:
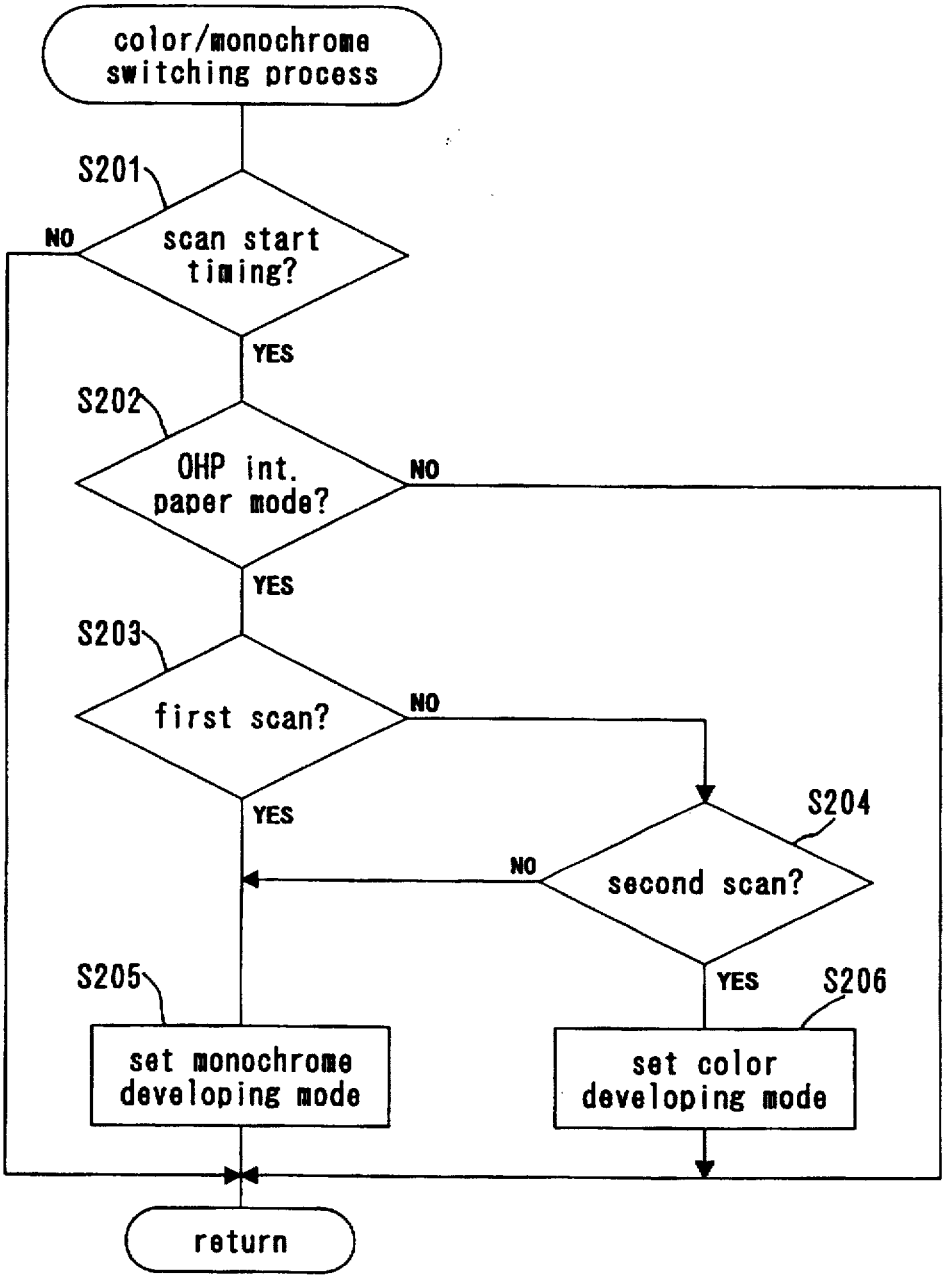
FIG. 5 is a flow chart showing a color/monochrome switching process executed by a CPU which controls the operation of the copying apparatus of the embodiment.
Figure 6:
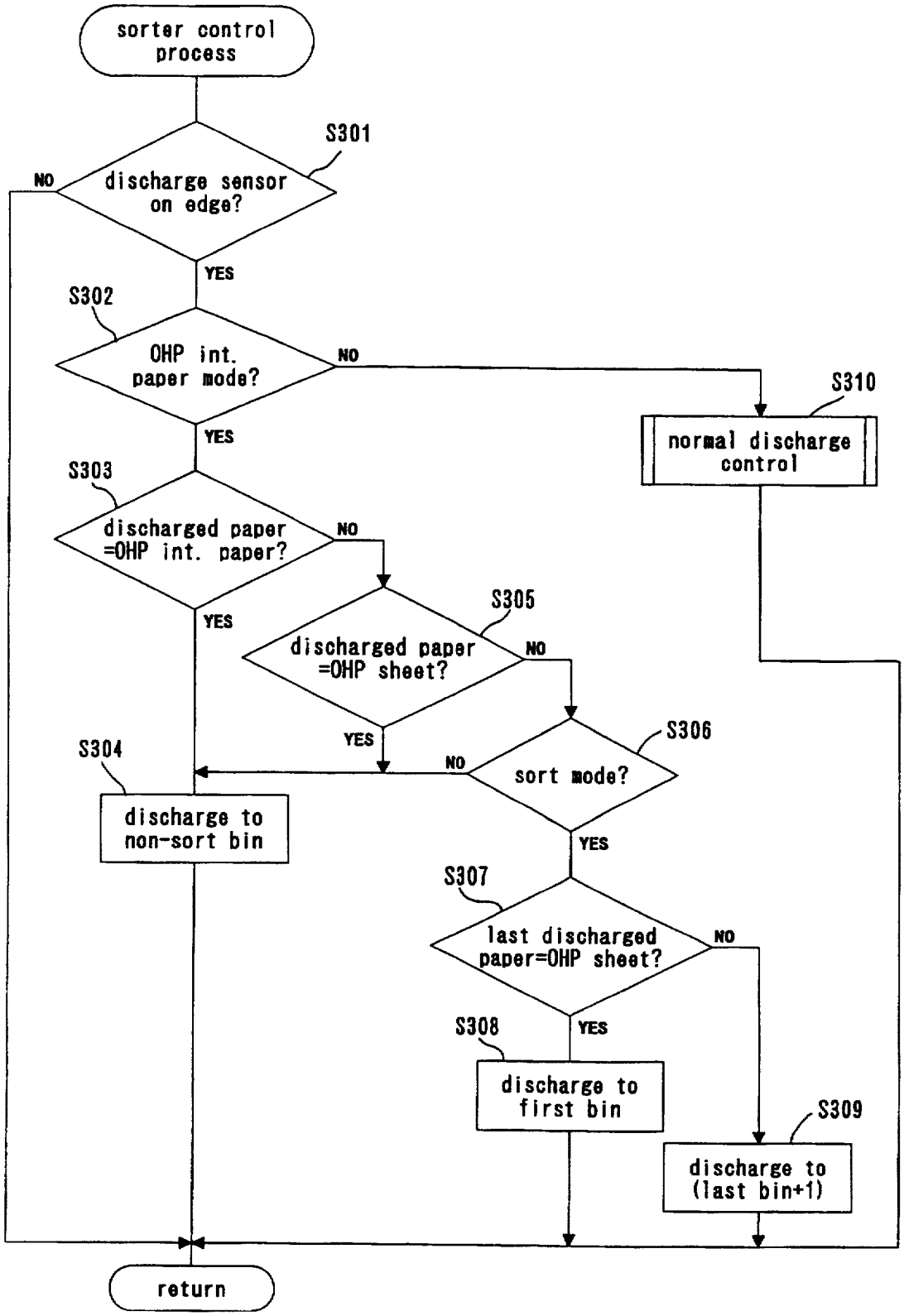
FIG. 6 is a flow chart showing a sorter control process executed by a CPU which controls the operation of the copying apparatus of the embodiment, and FIG. 7 (*a*) is an illustration showing the state after discharging OHP intervening sheets and OHP sheets, FIG. 7 (*b*) is an illustration showing the state after discharging copy sheets for distribution.

Hereinafter the process is explained referring to FIGS. 4 to 6 which is performed by CPU 109 during controlling copy operation sequence, when both OHP intervening sheet mode and color mode are set.

Feeding port switching process: FIG. 4

According to the feeding port switching process, when an OHP sheet is to be fed, manual feeding port 27d is selected, and when an OHP intervening sheet is to be fed, feeding port (27a, 27b or 27c) for OHP intervening sheet (normal paper of the same size as OHP sheets) is selected. And when normal paper is to be fed, feeding port (27a, 27b or 27c) for feeding the paper of designated size for distribution. In case that the paper of different size from OHP sheets is designated as copy paper for a document to be distributed, an optimum magnification may be automatically set in performing copy onto said paper for distribution.

In case that copy operation is not being executed (NO in S101), when print key 165 is pressed (YES in S102), the judgement is made whether or not OHP intervening sheet mode is set (S103). If OHP intervening sheet mode is set (YES in S103), a feeding cassette which accommodates normal paper of the same size as OHP sheets is set as the feeding port (27a, 27b or 27c) for OHP intervening sheets (S104). The size of OHP sheet is, for example, inputted by operation panel 16 to store that data in control memory 111.

When feeding of an OHP intervening sheet is completed (YES in S101, YES in S106 and YES in S107), feeding port 27d for OHP sheets is set to perform a copying process to OHP sheets thereafter (S108). Since the present embodiment shows an arrangement for setting OHP sheets at manual feeding port 27d as described above, manual feeding port 27d is set as the feeding port for OHP sheets in step S108. However, in case of such an arrangement as setting OHP sheets at another feeding port, said another feeding port may be set as the feeding port for OHP sheets.

When feeding of an OHP intervening sheet is completed (YES in S101, YES in S106, NO in S107 and YES in S109), a feeding port for the next copy operation is set.

That is, in case that multi-copy is designated to obtain a desired number of copies as documents for distribution, the feeding port for normal paper of the size designated for distribution is set (S111). Whether or not multi-copy is designated for distribution is determined in accordance with whether or not set copy number (N) is 1 (S110).

While, in case that multi-copy for distribution is not designated (YES in S101, YES in S106, NO in S107, YES in S109 and NO in S110), the feeding port for OHP intervening sheets (27a, 27b or 27c) is set so as to feed an OHP intervening sheet for the next document (S113).

When multi-copy for distribution is designated, the feeding port for normal paper is set as described above (S111), a designated number of sheets for multi-copying are fed (in the present example (N−1) sheets) and each copy operation is performed to each normal paper. When all these copy operations are completed (YES in S112), an OHP intervening sheet is fed for the next document and the feeding port (27a, 27b, 27c or 27d) for OHP intervening sheets is set to perform the following processes in the same way (S113).

Color/monochrome switching process: FIG. 5

According to the present apparatus, developing mode (full-color mode or monochrome mode) is determined in starting document image scanning. That is, full-color developing is performed for OHP sheets, and monochrome (black) developing is performed for OHP intervening sheets (and copies for distribution).

At a timing of start of scan (YES in S201), if the OHP intervening sheet mode is set (YES in S202), it is determined whether this is the first copy, the second copy or on and after the third copy for the identical document set on the platen (S203 and S204).

Since the first copy (YES in S203) is to be performed for OHP intervening sheet (refer to feeding port switching process), the mode for monochromatically developing the image read by scanning with a developing device for black development 23K is set (S205).

Since the second copy (YES in S204) is to be performed for OHP sheets, the mode for developing the image read by scanning using a plurality of developing devices (in full-color mode, developing devices for magenta development 23M, for cyan development 23C, for yellow development 23Y and black development 23K) in turn to obtain a full-color image (S206).

Since on and after the third copy (NO in S204) is multi-copy for distribution, the mode for monochromatically developing the image read by scanning with the developing device for black development 23K is set (S205).

In case that document for distribution is intended to be obtained with full-color copy, control should be changed so that if the result of step S203 is NO, the flow chart advances directly to step 206 skipping step 204.

Sorter control process: FIG. 6

Figure 7:
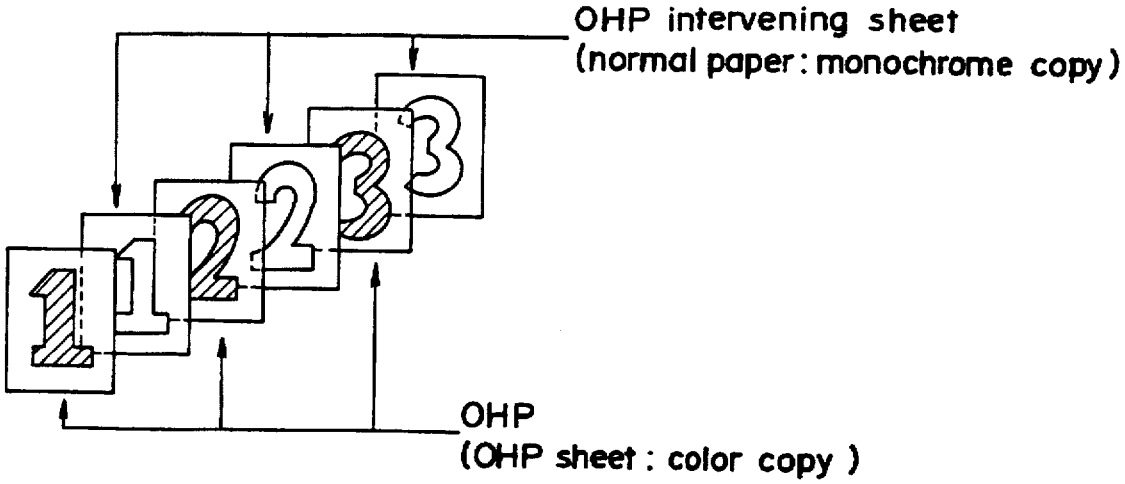
Figure 7:
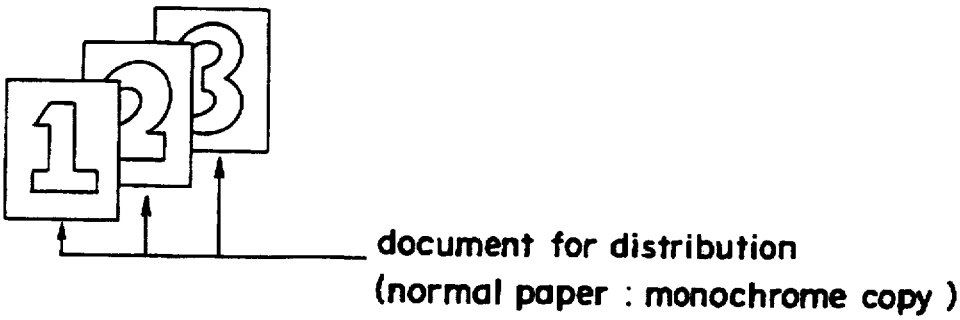

According to the present apparatus, both OHP intervening sheet and OHP sheets are discharged to non-sort bin 61 as shown in FIG. 7(*a*). When multi-copy is designated for distribution, each copy is sorted and discharged to sort bin group 62 from the uppermost bin in turn.

When an unillustrated discharge sensor provided in the main body detects that the leading edge of a sheet has passed the discharge port of the main body (YES in S301), it is determined whether or the not the OHP intervening sheet mode is set (S302). If OHP intervening sheet mode is not set (NO in S302), normal paper discharge control is executed (S310). That is, in non-sort mode, sheets are discharged onto discharge tray 61, and in sort mode or grouping mode, recording sheets are controlled to be sorted and discharged in accordance with respective mode.

When the OHP intervening sheet mode is set in step S302 (YES in S302), the bin to which sheets are to be discharged is determined in accordance with the kind of discharged paper and a discharge mode.

That is, when the discharged paper is an OHP intervening sheet (YES in S303), the OHP intervening sheet is discharged onto non-sort bin 61 (S304). Further, when the discharged paper is an OHP sheet (YES in S305), the OHP sheet is also discharged onto non-sort bin 61 (S304). Namely, as shown in FIG. 7(*a*), OHP sheets and OHP intervening sheets are discharged so that the OHP sheet completed color copy of document is piled on the OHP intervening sheet completed monochrome copy of the identical document.

If the discharged paper is neither an OHP intervening sheet nor an OHP sheet (NO in S303 and NO in S305), the discharged paper is a copy for distribution. The bin to which this copy for distribution is to be discharged is determined depending on whether or not sort mode is set.

Namely, when sort mode is not set (NO in S306), sheets are discharged onto non-sort bin 61 (S304) so as to be piled on an OHP sheet.

When the sort mode is set (YES in S306), copied sheets are sorted and discharged in turn so that the first sheet is discharged to the uppermost sort bin in sort bin group 62, the second sheet is discharged to the second bin and the following sheet is discharged in the same way. That is, if the latest discharged sheet is an OHP sheet (YES in S307), the next discharged sheet is the first sheet of the copy for distribution and thus discharged onto the first bin (uppermost bin) in sort bin group 62 (S308). If the latest discharged sheet is not an OHP sheet (NO in S307), the next discharged sheet is discharged onto the bin following (below) the bin on which the latest discharged sheet has been discharged (S309). As a result of such discharge, copies for distribution are piled on each bin for multi-copy (set sheet number (N)−1) in sort bin group 62, as shown in FIG. 7(*b*).

Other embodiment

Although the above embodiment is explained referring to a digital color copier, the present invention is also applicable with any apparatus which is possible to selectively execute color image formation and monochrome image formation and to discharge and pile OHP sheets formed with image thereon and OHP intervening sheets formed with the identical image thereon alternatively. Namely, an analogue color copier or a digital color copier is applicable.

Further, as for the image forming method, the present invention is not limited to an electrophotographic apparatus. The present invention is applicable to such an apparatus that is capable of forming a color image on OHP sheets and forming a monochrome image on normal paper.

Although the present invention has been fully described by way of examples with reference to the accompanying drawings, it is noted that various changes and modifications will be apparent to those skilled in the art. Therefore, unless otherwise such changes and modifications depart from the scope of the present invention, they should be construed as being included therein.

What is claimed is:

1. An image forming apparatus capable of forming a color image, comprising:

an image forming means for forming an image;

a setting means for setting an intervening sheet mode, said intervening sheet mode being set by one operation of an input key;

a copy operation control means for controlling a copy operation sequence, when the intervening sheet mode is set, to alternately discharge transparent sheets and corresponding intervening sheets, each transparent sheet being copied from an original document image and each corresponding intervening sheet being copied from the same original document image, so as to pile on each other; and an image forming control means for controlling the image forming means, under said copy operation sequence in the intervening sheet mode, to form color copy images on the transparent sheets and to form monochrome copy images on the intervening sheets.

2. The image forming apparatus as claimed in claim 1, wherein said intervening sheets are normal copy sheets of the same size as the transparent sheets.

3. The image forming apparatus as claimed in claim 1, further comprising a multi-copy designating means for designating a multi-copy under the intervening sheet mode to obtain copies of the original document images on normal sheets separately from said intervening sheets and transparent sheets.

4. The image forming apparatus as claimed in claim 3, wherein, when the multi-copy is designated, said image forming control means controls the image forming means to form monochrome copy images on normal sheets for the multi-copy.

5. An image forming apparatus capable of forming a color image, comprising:

an image forming means for selectively forming a color image or a monochrome image of an original document;

a mode setting means for setting an intervening sheet mode to alternately discharge transparent sheets and corresponding intervening sheets, each transparent sheet being copied from an original document image and each corresponding intervening sheet being copied from the same original document image, so as to pile on each other, said intervening sheet mode being set by one operation of an input key; and a control means for controlling said image forming means, when the intervening sheet mode is set, to form a color image on a transparent sheet, and to form a monochrome image on a sheet other than the transparent sheet.

6. The image forming apparatus as claimed in claim 5, wherein said intervening sheets are normal copy sheets of the same size as the transparent sheets.

7. The image forming apparatus as claimed in claim 5 further comprising a multi-copy designating means for designating a multi-copy under the intervening sheet mode to obtain copies of the original document on normal sheets separately from said intervening sheets and transparent sheets.

* * * * *